US005894995A

United States Patent [19]

Mazzei

[11] Patent Number: 5,894,995

[45] Date of Patent: Apr. 20, 1999

[54] INFUSION NOZZLE IMPARTING AXIAL AND ROTATIONAL FLOW ELEMENTS

[76] Inventor: Angelo L. Mazzei, 11101 Mountain View Rd., Bakersfield, Calif. 93307

[21] Appl. No.: 08/889,780

[22] Filed: Jul. 8, 1997

[51] Int. Cl.[6] ..... B05B 1/34

[52] U.S. Cl. ..... 239/489

[58] Field of Search ..... 239/472, 489, 239/487, 590.5

[56] References Cited

U.S. PATENT DOCUMENTS

| | | | |
|---|---|---|---|
| 550,336 | 11/1895 | Williams | 239/489 |
| 2,603,280 | 7/1952 | Bernhard | 239/489 X |
| 2,765,028 | 10/1956 | Kienle | 239/489 |
| 3,033,278 | 5/1962 | Scarr | 239/487 X |
| 3,556,412 | 1/1971 | Vietoisz | 239/489 X |

*Primary Examiner*—Andres Kashnikow
*Assistant Examiner*—Sean P. O'Hanlon
*Attorney, Agent, or Firm*—Donald D. Mon

[57] ABSTRACT

A stream preparation nozzle which establishes dynamic properties in regions of an already mixed stream of treatment water that comprises water and a treatment substance. The nozzle discharges directly into a body of untreated water. The dynamic properties of the stream created by this nozzle improve the infusion of the treatment water and its treatment substances into the water in the body of water.

8 Claims, 2 Drawing Sheets

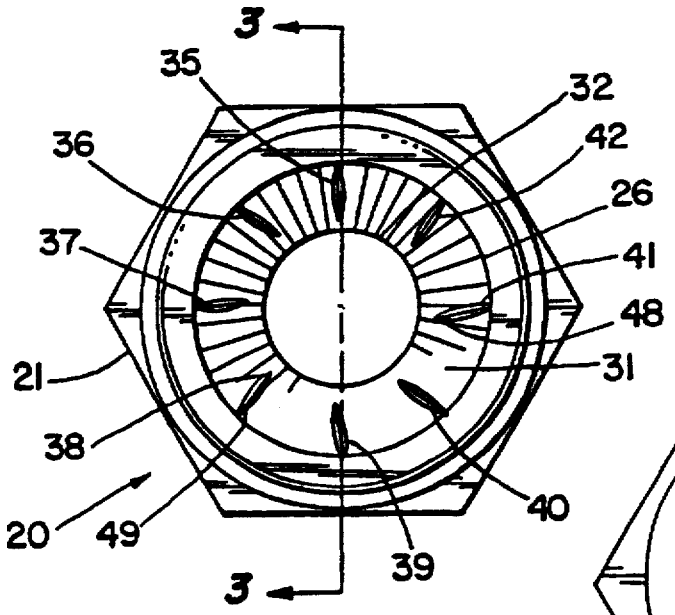
Fig. 1
Fig. 2
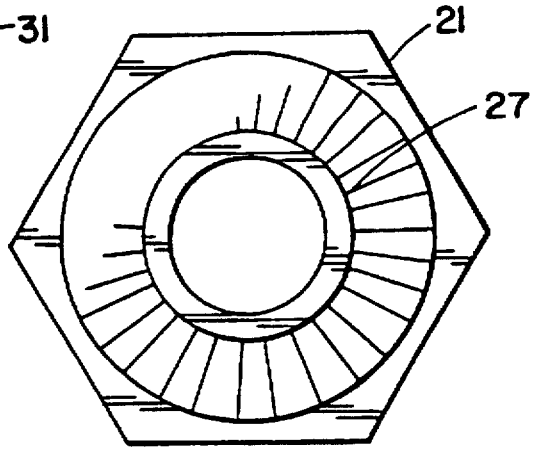
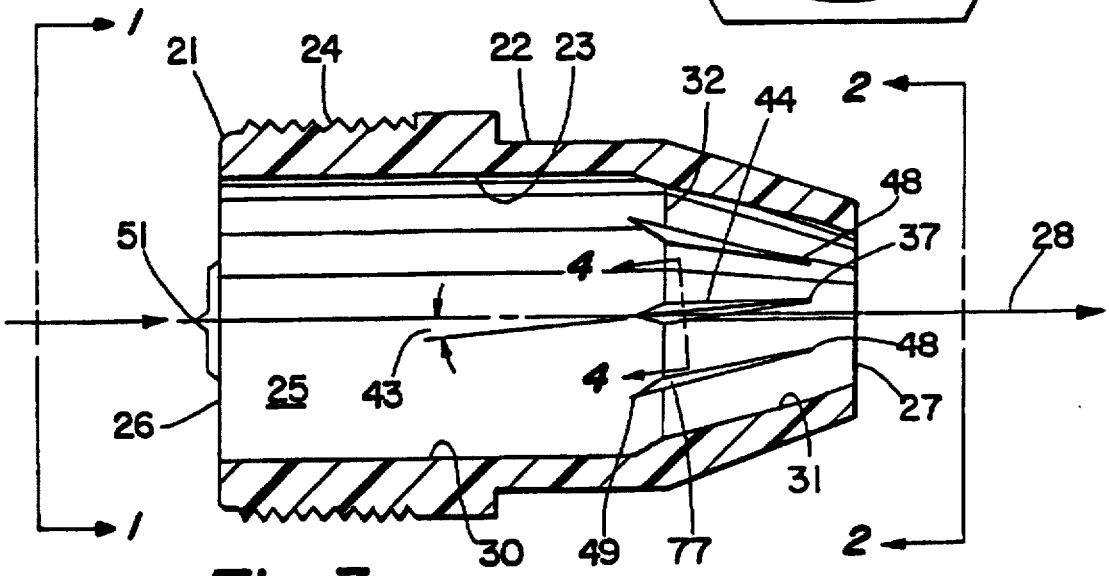
Fig. 3
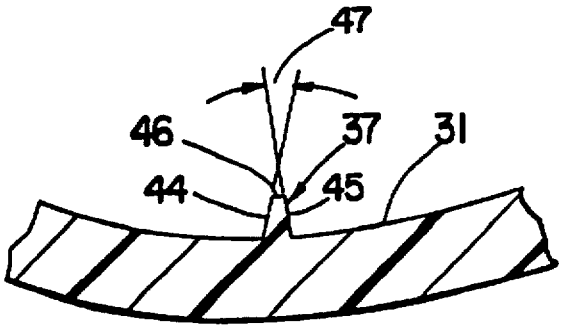
Fig. 4

INFUSION NOZZLE IMPARTING AXIAL AND ROTATIONAL FLOW ELEMENTS

FIELD OF THE INVENTION

An infusion nozzle to infuse treatment water into a body of water to provide optimum dispersion of the treatment water and its contents into the water of the body.

BACKGROUND OF THE INVENTION

During treatment of the water in bodies of water such as aquariums, ponds, pools and spas, it is standard practice to treat a smaller amount of water ("treatment water" herein) and then inject it into the larger body so that the larger body becomes infused with the treatment substances that are carried by the treatment water. Ozone, oxygen, air, and chlorine are frequently injected into the treatment water, and are carried by it to the larger body where it can serve to control odor and bacteria, for example. There are many other examples, all of which rely on infusing the treatment substances so they are thoroughly dispersed throughout the larger body of water.

Apparatus to inject treatment substances, which may be liquids as well as gases, into treatment water, is well developed. One suitable device is an aspirating injector of the type shown in Mazzei patent No. 4,123,800, which is incorporated herein by reference for its showing of injection of treatment substances into water to form a treatment water, and an injector for doing so. The objective is to provide a high concentration of treatment gas or liquid in the treatment water which, when dispersed in the larger body will control whatever nuisance or risk is involved.

Of course the effectiveness of this procedure is dependent on thorough dispersal of the treatment material. Quite frequently the treatment material will be present at the infusion nozzle both in saturated solution in the treatment water and as bubbles. If bubbles of gas are large and merely float to the surface and burst, the gas is lost, and may even be a hazard. For example, discharge of ozone into the air is strictly regulated, and often systems must be operated with less than optimum ozone throughput in order that undissolved ozone will not escape from the water.

It is an object of this invention to provide an infusion nozzle from which treatment water is injected into a body of water with an improved flow pattern that provides a flow into the larger body in which the bubbles are not only small and well-distributed, but are in a flow stream that, as it infuses into the larger body, incorporates in itself a large region of previously-untreated water in the body. The bubbles are thereby more fully distributed and dissolved in the body of water to be treated.

These objects are attained with only minor energy loss, so that the force and "range" of the plume of treated and directly affected water is not appreciably shortened. This advantage is so pronounced that the output from this infusion nozzle can be used to sweep the bottom of a tank, providing a wider swath, and a vigorous mixing action as well.

BRIEF DESCRIPTION OF THE INVENTION

An infusion nozzle according to this invention includes a nozzle body having a flow passage therethrough. The flow passage has an entry port, an exit port and a circularly-sectioned wall extending along a central axis between the two ports.

The wall includes an entry portion that extends from the entry port and is substantially cylindrical with a diameter. It further includes a constricting portion which is preferably frusto-conical, with a diameter that reduces as it extends away from the entry portion. It extends to the exit port, at the smaller end of the constricting portion.

A plurality of vanes projects into the passage from the wall. Each vane extends partway into the entry portion and partway into the constricting portion. These vanes have a dimension of length, a thickness, and a deflection face which faces the oncoming stream of water from the entry port. Their ends closer to the exit port are spaced from the exit port. Each includes a crest which extends into the entry portion and into the constricting portion. The deflection surface terminates at the crest and forms a small angle relative to a plane that includes the central axis and passes through the vane where the vane intersects the junction between the entry portion and the constricting portion.

The vanes are symmetrically spaced apart from one another. Their crests do not cross the central axis.

As a consequence, a substantial outer portion of the flowing liquid is deflected to receive a rotational component of motion while a central "core" of the flowing stream continues on a straight-through axial path.

The resulting fluid stream exiting the nozzle exhibits both axial and radial velocities greater than the velocity of the fluid into which the stream is infused. Therefore, due to this relatively higher velocity of the stream along its entire length, its pressure is lower than that of the water or fluid into which it is infused (as explained by Bernoulli's principle). This results in an active entrainment of untreated water or fluid into the stream along the entire length of the stream in volumetric ratios many times the volume of the entering stream from the nozzle.

The above and other features of this invention will be fully understood from the following detailed description and the accompanying drawing, in which:

BRIEF DESCRIPTION OF THE DRAWINGS

FIG. 1 is an end view of an infusion nozzle according to this invention taken at line 1—1 in FIG. 3;

FIG. 2 is an end view taken at line 2—2 in FIG. 3;

FIG. 3 is a cross-section taken at line 3—3 in FIG. 1;

FIG. 4 is a fragmentary cross-section taken at line 4—4 in FIG. 3;

DETAILED DESCRIPTION OF THE INVENTION

Figure 5:
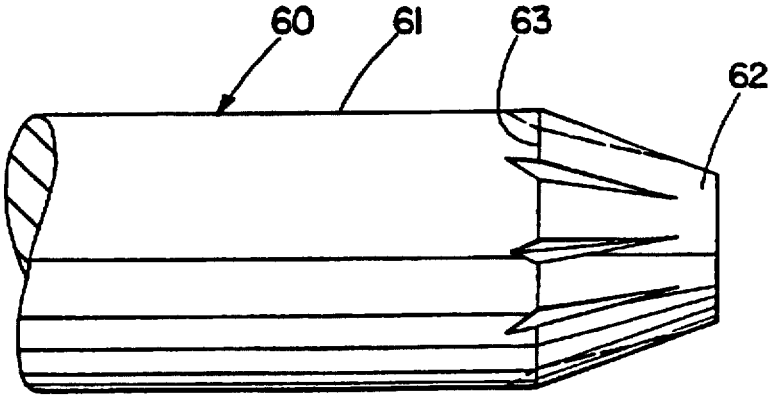
FIG. 5 is a fragmentary side view of a plug useful in the manufacture of the nozzle of FIG. 3.

The presently-preferred infusion nozzle 20 of this invention is shown in FIG. 1. It includes a body 21 having an outer wall 22 and an inner wall 23. Mounting threads 24 may be provided on the outer wall.

Inner wall 23 forms a flow passage 25 with an inlet port 26 and an exit port 27. The inner wall is circularly sectioned and extends along central axis 28 between the two ports.

Inner wall 23 includes an entry portion 30 that extends from the entry port. It is substantially cylindrical, although it may have a slight narrowing taper if desired. It further includes a constricting portion 31 which is preferably frusto-conical. Its diameter reduces as it extends away from the entry portion. The entry portion and constricting portion meet at a junction 32 which is normal to the central axis. Constricting portion 31 extends to the exit port, at its smaller end.

A plurality of vanes 35, 36, 37, 38, 39 40, 41 and 42 are symmetrically placed around the inner wall. In the illustrated example, there are eight of them. More or fewer could be provided, but eight appears to be optimum for the intended results. All are identical, so only vane 37 will be described in detail.

Figure 12:
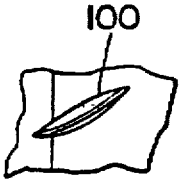
FIG. 12 is a view like FIG. 6, but of a different vane shape.

The vanes are linear, although they could be slightly curved if desired (see FIG. 12). However, these nozzles will usually be molded with the use of a mold cavity to form the outside wall, and a plug to form the inside wall, including the vanes. With the disclosed geometry of the inner wall, the plug can be pulled out axially without rotating it.

Vane 37 is slanted at a small deflection angle 43 (FIG. 3), between about 3 to 15 degrees, but usually about 4 degrees, relative to a plane which includes the central axis and also passes through junction 32 where it crosses the vane. While quite small, this angularity gives a sufficient rotational component to an outer portion of the stream for the purposes of this invention.

The vane is preferably formed with a wedge-like shape as shown in FIG. 4. It has a deflection face 44 facing toward the oncoming stream, and a rear face 45 facing toward the exit port. It is a convenience in molding to provide the crest 46 of the vane as a bent flat surface. The faces 44 and 45 preferably form a dihedral angle 47 between them, preferably about 20 degrees, but which can vary between about 5 degrees to about 40 degrees. This further facilitates the removal of the plug after the device is molded.

The vanes are aligned with one another. Each extends partway into the entry portion, and partway into the constricting portion. Their ends 48 are spaced from the exit port, and their ends 49 are spaced from the entry port. They extend across junction 32. Crest 46 extend at a crest angle 50 (see FIG. 8) relative to the central axis as they rise from the entry portion, and fair into the constricting portion. It will be noticed that the vanes do not reach the central axis. It is not intended to rotate the entire stream, but only a limited outer portion of it.

As can best be seen in FIG. 1, there are axial regions 51 of the stream which do not encounter a vane. While more occlusion can be provided by using more vanes, or even by using steeper vanes, or vanes which approach the axis more closely, it would be at the cost of an unnecessary increase in energy loss from the stream. The illustrated arrangement, which can be scaled, provides a sufficient rotational effect.

The construction of the vanes can best be understood from an examination of the tooling plug which forms them when they are molded. FIG. 5 shows a plug 60 having an external surface 61 that forms entry portion 30, a conical portion 62 that forms the constricting portion 31, and an intersection 63 which forms junction 32.

Figure 6:
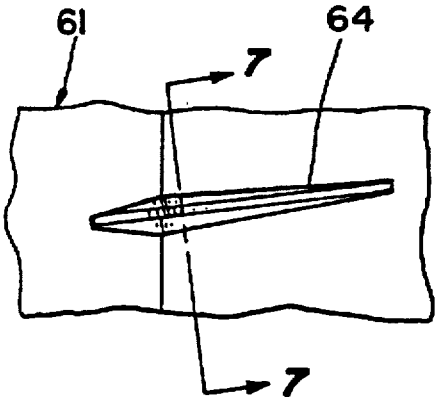
FIG. 6 is a fragmentary top view of FIG. 5.
Figure 7:
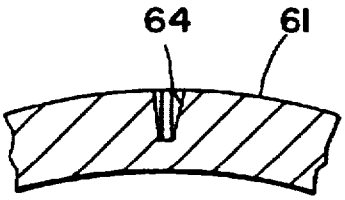
FIG. 7 is a fragmentary cross-section of a slot in the plug of FIG. 5, taken at line 7—7 in FIG. 6.

Identical slots 64 are cut into the plug as shown in FIG. 6. They are formed by a milling cutter whose cutting edges are complementary to the surfaces of the slots. Plug 60 will form the inner wall and the vanes when the infusion nozzle is molded.

Figure 8:
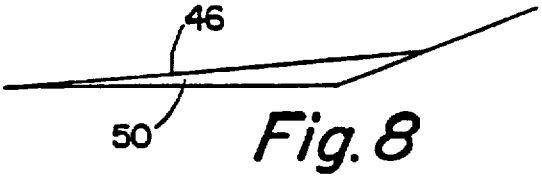
FIGS. 8, 9 and 10, are schematic showings of various vanes.
Figure 9:
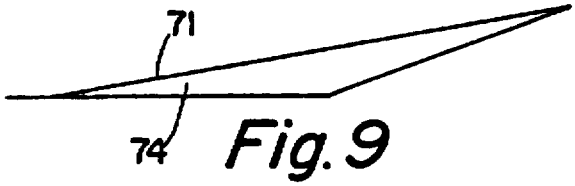
Figure 10:
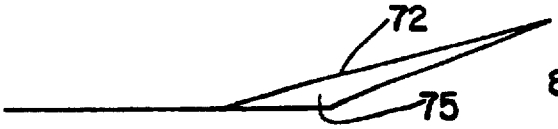

FIGS. 8, 9 and 10 schematically show vanes 46, 71 and 72 formed by cutting the slots at different angles 50, 74, and 75. These change the length, height, and excursion into the wall portions as shown. This is a convenient way to provide vanes for different diameters and flow rates. Generally the angle shown in FIGS. 3 and 10 is preferred. Its angle 75 is about 15 degrees, but it can vary between about 5 degrees and 20 degrees.

It is an advantage in the molding process to shorten the extent to which the vanes extend into the entry portion. As shown in FIG. 3, the crest of the vane 48 has a curve 77 at its upstream end. This is optional.

FIG. 12 shows a vane 100 in all respects like vane 37 in FIG. 6, except that its crest slightly curved rather than straight, to provide additional twist to the outer part of the stream, if desired.

Figure 11:
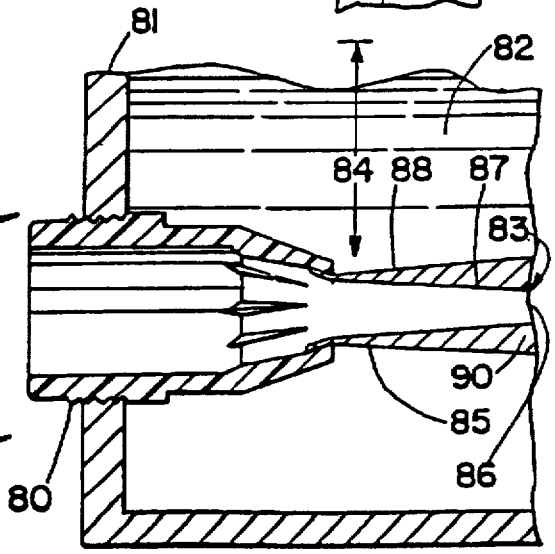
FIG. 11 is a schematic showing of some properties of the stream produced by the nozzle of FIG. 3.

While the actual dynamics of this infusion nozzle are not fully understood, the following description of the results it provides will be helpful. FIG. 11 shows an infusion nozzle 80 such as nozzle 20 mounted to the wall of 81 a tank containing a body of water 82 which requires treatment.

FIG. 11 schematically shows a stream 83 of treatment water, usually containing dissolved and undissolved treatment gas, being injected at a depth 84 into water 82. While in the nozzle, the vanes have given a rotational component of motion to least a part of a peripheral zone 85 of treatment water. The central core 86 does not have that component because it does not encounter a vane. Zone 85 is formed around core 86, almost as a cylindrical coaxial shell.

Mixing will immediately begin at the interface 87 between zone 85 and core 86. This rotary and axial mixing motion continues as the stream from the nozzle passes into the tank. In the tank, this will also occur at the interface 88 between the untreated water in the tank and zone 85. As a consequence, an increased amount of waters mixed from treatment water and untreated water occurs in a steadily enlarging region 90 in the body of water, which extends both inwardly and outwardly of zone 85.

Comparisons of the outputs of nozzles which are identical except that one has vanes and the other does not, are instructive. Without vanes there is no peripheral zone 87. There is some mixing around the axial stream, but it is small, and mixing does not start until the stream is well into the tank. If one places his hand underwater around the stream next to the nozzle and moves it along the stream, he will notice that the mixing region around the stream, which he can actually feel, starts rather far into the tank, and is not particularly vigorous. Bubbles of gas will often be seen rising to the surface.

If one replaces that nozzle with a nozzle according to the invention and repeats this exercise, he finds very close to the exit port the start of a region of vigorous mixing- zone 90. Peripheral zone 87 has an interface 88 with the surrounding untreated water in the tank, and another interface 87 with the axially-moving core. Region 90 can be felt blooming to an increasing and substantial diameter, within which shear forces on the bubbles at both interfaces lead to the rapid disappearance as their gas is dissolved. There is a substantial absence of bubbles at the surface.

Region 90 is active, and tends to draw nearby untreated water and particulates to it. For this reason, the stream is quite effective for sweeping the bottom of a tank, for example.

A set of dimensions suitable for a nozzle according to this invention is as follows:

Included conical angle of the constricting portion: 40 degrees

Diameter of the entry portion: 1.60 inches

Exit port diameter: 0.75 inches

Angle of the vanes relative to the plane through the central axis: 4 degrees

Distance from the exit port to the nearest end of the vanes: 0.25 inches

This invention is not to be limited by the embodiments shown in the drawings and described in the description, which are given by way of example and not of limitation, but only in accordance with the scope of the appended claims.

I claim:

1. A stream preparation nozzle to establish dynamic properties in regions of an already mixed stream of treatment water comprising water and a treatment substance to improve the infusion of said treatment water in said body of water into which it directly discharges beneath the surface of said body of water, said nozzle comprising:

a nozzle body having an internal wall which forms a flow passage, said flow passage extending between an entry port into, and an exit port out of said flow passage, said nozzle body adapted to receive said stream under pressure at said entry port, and said wall being circularly-sectioned and extending along a central axis between said ports, said internal wall including an entry portion extending from said entry port, a constricting portion extending from its junction with the entry portion to the exit port, said constricting portion decreasing in diameter from said junction to said exit port, and a plurality of vanes extending from said junction into said entry portion and into said constricting portion, said vanes being equally spaced around said central axis, and including a deflection face facing toward said entry port and a crest rising at a crest angle to said central axis toward said central axis and fairing into said constricting portion at a point spaced from said exit port, said vanes being disposed at a deflection angle to a plane that contains said central axis and the intersection of the respective vane with said junction, said flow passage being devoid of any impediment to or separation of flow other than said vanes, and being devoid of any means to add any substance to said stream;

whereby the outer annular portion of the cylindrical stream of treatment water in said entry portion encounters said vanes, while a central core portion of said stream does not, said outer portion thereby being given a rotating twisting motion relative to said core portion, said annular portion after the stream leaves the exit port reacting dynamically with both the water of the body of water and with the water of the core portion, thereby enlarging the region of active mixing of the treatment water and the water of the body of water.

2. A nozzle according to claim 1 which said crest angle is between about 10 degrees to about 40 degrees.

3. A nozzle according to claim 1 in which said deflection angle is between about 3 degrees and about 15 degrees.

4. A nozzle according to claim 3 in which said deflection angle is about 4 degrees.

5. A nozzle according to claim 1 in which said constricting portion is the frustum of a cone having an included conical angle of about 40 degrees.

6. A nozzle according to claim 1 which the number of said vanes and their respective deflection angle is selected so that a region of a stream flowing from said nozzle has a central core of axially moving water with a region around. the core having at least some rotational component derived from contact with said vanes.

7. A nozzle according to claim 1 in which said crest is straight.

8. A nozzle according to claim 1 in which said deflection face is curved concavely facing toward said inlet port.

* * * * *